US007122728B1

(12) United States Patent
Russo

(10) Patent No.: US 7,122,728 B1
(45) Date of Patent: Oct. 17, 2006

(54) STRING LEVELING DEVICE AND METHOD OF USE THEREOF

(76) Inventor: Stephen M. Russo, 82 Ann Ter., Park Ridge, NJ (US) 07656

( * ) Notice: Subject to any disclaimer, the term of this patent is extended or adjusted under 35 U.S.C. 154(b) by 192 days.

(21) Appl. No.: 10/866,390

(22) Filed: Jun. 12, 2004

(51) Int. Cl.
*G10C 3/10* (2006.01)

(52) U.S. Cl. ..... 84/200; 84/312 R

(58) Field of Classification Search ..... 84/200, 84/312 R, 433, 453, 454, 423 R, 455
See application file for complete search history.

(56) References Cited

U.S. PATENT DOCUMENTS

| | | | | |
|---|---|---|---|---|
| 3,675,529 | A | 7/1972 | Van Der Woerd | |
| 4,127,051 | A | 11/1978 | Conklin, Jr. | |
| 4,253,374 | A | 3/1981 | Watterman | |
| 4,319,515 | A * | 3/1982 | Mackworth-Young | 84/454 |
| 5,065,660 | A | 11/1991 | de Buda | |
| 5,423,241 | A | 6/1995 | Scarton et al. | |
| 5,528,970 | A | 6/1996 | Zacaroli | |
| 5,654,515 | A | 8/1997 | Youse | |
| 5,756,913 | A | 5/1998 | Gilmore | |
| 6,107,556 | A | 8/2000 | Gilliam | |
| 6,278,047 | B1 | 8/2001 | Cumberland | |
| 6,348,645 | B1 * | 2/2002 | Yamashita | 84/217 |
| 6,479,738 | B1 * | 11/2002 | Gilmore | 84/454 |
| 6,489,548 | B1 | 12/2002 | Schindler | |
| 6,559,369 | B1 | 5/2003 | Gilmore | |

OTHER PUBLICATIONS

40th Annual PTG Convention (1997)—Mini Technical Classes—Michael Vecchione, *Making Unisons Sound Spot On.*

40th Annual PTG Convention (1997)—Mini Technical Classes—Clair Davies, *String Leveling.*

1998 www.ptg.org—John Woodrow, *String Leveling Questions.*

Del Fandrick, RPT, Q. and A. On the Level, *Piano Technicians Journel* (PTJ), vol. 38, No. 2 (1995).

Clair Davies, RPT *String Leveling by Ear, PTJ*, vol. 40, No. 11 (1997).

*Solution for Agraffe Noise, PTJ*, vol. 32, No. 8 (1989).

*Q. and A. Fuzzy, False Tone, PTJ*, vol. 29, No. 3 (1986).

Virgil E. Smith, *Criminal Negligence in Piano Service, PTJ*, vol. 36, No. 10 (1993).

David W. Pitsch, RPT, *After Touch, PTJ*, vol. 25, No. 12 (1982) and vol. 26, No. 4 (1983).

Susan Graham, *Agraffes, PTJ*, vol. 27, No. 5 (1984).

Selections from *Five Lectures on the Acoustics of the Piano Proceedings of the Royal Swedish Academy of Piano* (1990) as published at www.speech.kth.se.

* cited by examiner

*Primary Examiner*—Lincoln Donovan
*Assistant Examiner*—Jianchun Qin
(74) *Attorney, Agent, or Firm*—Siegmar Silber

(57) ABSTRACT

A unison gauge for indicating levelness of a string set of a grand piano is described. The gauge has a contact block adjustably engageable with the lowermost tangential aspect of the string set. Battery powered indicators provide an indication for each string. With the piano action withdrawn from the piano case, the base of the device rests on the key bed below the piano hammer strike area of the string set and holds the contact block mounted thereon on an extendable mast. The contacts of the contact block are in a plane parallel to the key bed. The contact block is under slight spring tension when engaged with a string set being monitored and, upon compression of the spring readily slides along the key bed to the next string set. A method of use of the unison gauge is also provided.

19 Claims, 8 Drawing Sheets

STRING LEVELING DEVICE AND METHOD OF USE THEREOF

BACKGROUND OF THE INVENTION

1. Field of the Invention

This invention relates to a device for determining the levelness of compound strings or string sets, namely bichords and trichords, of a grand piano. The device uses the upper surface of the key bed of the piano as a reference surface and determines levelness of the aforesaid string sets. In addition to the string leveling device, a method of use thereof is provided.

2. Description of the Prior Art

The history of the modern piano begins with the pianoforte developed by a harpsichord builder, Bartolommeo Christofori. Christofori invented the instrument in Florence in 1709 and completed a prototype around 1720. The main driving force behind the instrument's development was that, in contradistinction to the predecessor instruments—the harpsichord and the clavichord—the piano provided variations in volume. Additionally development was spurred on by the desire to play fuller, less delicate music.

Musicians of the time sought a full rich sound and were unsatisfied by the strong and uniform harpsichord tone produced by plucking large strings with keyboard-controlled quills. On the other hand, the percussive action of the clavichord, while allowing for variations in volume, produced weak tones by striking brass hammers against small, thin strings.

Of the several versions of the piano invented in the Eighteenth century, Christofori's pianoforte, is most closely related to the modern-day grand piano in that the hammers thereof are wooden blocks covered on the striking surface with soft leather. Later in the Eighteenth century a piano hammer was designed with the same basic shape that survives today. In this design, two layers of leather were used with the inner layer being a firm leather, and the outer layer being softer. The final form of the leather covered piano hammer used three layers of leather of varying firmness with the softest leather on the outside and the firmest layer on the inside. This provided a piano hammer that was soft and compliant at the surface to provide the requisite tone for pianissimo playing and a hammer firmer underneath to provide the strength for forte playing.

As the grand piano developed, it became more and more a solo instrument, and needed to be louder. To increase volume, strings needed to be thicker and the support structure stronger, so that greater tension could be achieved. The frame of the pianos, commonly made of wood, became thicker and heavier, and was strengthened by cross-bracing. By 1820, English manufacturer John Broadwood began to build iron hitch pin plates, which now meant plates were made of more metal than wood. In 1825 Alpheus Babcock patented the cast-iron frame and further in 1843, American manufacturer Jonas Chickering began making pianos with the full-perimeter plate—a feature of modern grand pianos.

In 1821 a French builder, Sebastian Erard, invented the last major basic refinement of the piano action; the double escapement. Shortly thereafter, the heavy iron frame required by the action and the higher tensioned strings was provided, and then cross-stringing, a system whereby the long bass strings cross over the shorter middle-range strings, was invented.

After the invention of the iron frame for the strings on a piano, heavier strings, including bichords and trichords, could be used at higher tensions to produce a fuller sound from the piano. This rendered the leather covered piano hammer unacceptable. The result was the development and patenting of a felt covered piano hammer by Alpheus Babcock in 1833. These hammers provided a more acceptable tone than the leather covered hammers. In the late Nineteenth century machines were invented to cover the raw wood piano hammers with felt. The felt hammers enabled the manufacturer to fine tune the tone of the piano by adjusting the hardness of the felt. The process of tonally regulating the piano hammers is called voicing, requires skilled piano technicians, and is a time consuming operation. Initially, the piano hammer felt is checked for proper shaping, particularly that the striking surface is flat across the width thereof. During voicing, the technician adjusts the tone of a hammer by adjusting the softness or the hardness of the hammer felt. When a tone sounds too soft, by applying a solution of lacquer and lacquer thinner to the hammer felt the technician adjusts the felt hardness and the tone produced at that site. Alternate methods of adjusting hammer felt hardness include working the hammer felt with a needle to loosen the fibrous structure thereof.

String leveling of a grand piano is a process completed before voicing or the adjustments of the felts of the hammers. If the string sets—bichords and trichords—are not level, the strike of the corresponding hammer produces a fuzzy note and the damping of the strike is not properly accomplished. This creates what is referred to as an aftersound or ring, which, in turn, destroys the normal clarity or definition of individual notes of the instrument. In practice, piano technicians are trained to detect unlevel string sets by ear. Upon detection, the technician is presently taught to correct the condition by withdrawing the piano action and placing the end of a steel rule on the string set to sight along the string. When gaps are present, the sagging string is drawn up to the higher string by shortening or kinking the string.

A complete piano action consists of thousands of parts and weighs on the order of 30 kilograms or more and hence has a substantial support or key bed on which the action rests when in the piano case. The key bed is rigidly connected to the piano case and is an integral part of the piano case. Because a mechanical coupling exists between the key bed and the piano soundboard through various components of the piano case, vibrations originating at the key bed are transmitted through the frame of the piano to the soundboard to produce extraneous noise, such as the aftersound, supra, which detract from the tonal integrity of the instrument. Consequently, in a grand piano, as the frame of the piano action is in intimate contact with the key bed, it is critical that the key bed be perfectly flat and that the string sets be precisely level with respect thereto.

There are two other aspects of the grand piano manufacture and maintenance that are impacted by string leveling—the una corda pedal action for playing pianissimo and the damping mechanism for curtailing and ending the resonating of a string set. The una corda pedal in the modern grand piano is the left pedal and shifts the piano action sufficiently in the key bed to enable the piano hammers to strike only one string of each bichord unison and two strings of each trichord unison. This places a further requirement on key bed construction to permit a noiseless sliding of the piano action relative to the key bed whenever the una corda pedal is depressed. The description of the una corda pedal and the action thereof is found in a patent to Harold A. Conklin, Jr., U.S. Pat. No. 4,127,051, which description is incorporated herein by reference.

In the grand piano, the damping mechanism curtails and ends the resonating of a string or string set. The depressing of a key raises a damper wire which, in turn, supports a damper head and the attached damper felt and thereafter, upon release, the damper assembly falls on the string or string set. For even damping across the entire range of the piano, the weight of the damper assembly is varied in accordance with the size and tension of the string or string set so as to have a correspondingly even damping influence on the resonance thereof. The damper felt has a longitudinal aspect which for proper damping action needs to be in full contact with the string or string set. At a pre-determined node when a string set is not level, the damping mechanism does not seat properly thereon and results in a partially damped note. This is created by one or two strings ceasing to resonate and by the remaining undamped string sustaining the note until the natural decay occurs.

In manufacturing a grand piano the process of string leveling is accomplished prior to voicing which was described by Franz Mohr of Steinway as open work (or work with the piano action withdrawn from the piano case). The manufacturer anticipates that during the initial period of use, the instrument will be tuned, string leveled and voiced with greater frequency. This results as the outer portion of the hammer felts continue to be further shaped by the initial play by the pianist. Additionally, the tuning-string-leveling-voicing process takes on particular importance when a pianist individualizes the grand piano for concerts or recording sessions. When voicing is attempted without the pre-requisite string leveling, the shaping and the hardening of hammer felts do not provide the desired clarity as a hammer strike on an uneven string set produces tones with differing decays.

Similarly, in regulating the mechanical arrangement of the una corda pedal, unlevel strings create a condition in which the hammer strikes, instead of squarely meeting the string (bichord) or string set (trichord), are frequently glancing blows. This produces an uneven tonal quality that is readily heard because of the pianissimo mode.

The effect of unlevel string sets when adjusting the damper mechanism is described in a December, 2002 article in the *Piano Technicians Journal*. Andrew Remillard in an article entitled *Dampers: Peace and Quiet at Last* indicates that for proper adjustment of the dampers the strings need to be level because, "if one string hangs a little beneath its neighbor it will be virtually impossible to ever completely dampen it."

Prior to preparing this application, the inventor became familiar with several patents concerned with grand piano manufacture and maintenance, which patents are included herein as further background material. The patents are:

| ITEM NO. | U.S. PAT. NO. | INVENTOR | ISSUE DATE |
|---|---|---|---|
| 1. | 6,559,369 | Gilmore | May 6, 2003 |
| 2. | 6,489,548 | Schindler | Dec. 3, 2002 |
| 3. | 6,479,738 | Gilmore | Nov. 12, 2002 |
| 4. | 6,278,047 | Cumberland | Aug. 21, 2001 |
| 5. | 6,107,556 | Gilliam | Aug. 22, 2000 |
| 6. | 5,756,913 | Gilmore | May 26, 1998 |
| 7. | 5,654,515 | Youse | Aug. 5, 1997 |
| 8. | 5,528,970 | Zacaroli | Jun. 25, 1996 |
| 9. | 5,423,241 | Scarton et al. | Jun. 13, 1995 |
| 10. | 5,065,660 | de Buda | Nov. 19, 1991 |

-continued

| ITEM NO. | U.S. PAT. NO. | INVENTOR | ISSUE DATE |
|---|---|---|---|
| 11. | 4,253,374 | Watterman | Mar. 3, 1981 |
| 12. | 4,127,051 | Conklin, Jr. | Nov. 28, 1978 |
| 13. | 3,675,529 | Van Der Woerd | Jul. 11, 1972 |

Additional background information was obtained from several nonpatent references, namely:

14. 40$^{TH}$ Annual PTG Convention (1997)—Mini Technical Classes—Michael Vecchione, *Making Unisons Sound SPOT ON*
15. 40$^{TH}$ Annual PTG Convention (1997)—Mini Technical Classes—Clair Davies, *String Leveling*
16. 1998 www.ptg.org—John Woodrow, *String Leveling Questions*
17. Del Fandrick, RPT, *Q. and A. On the Level, Piano Technicians Journal* (*PTJ*), Vol 38, No. 2 (1995)
18. Clair Davies, RPT *String Leveling by Ear, PTJ*. Vol. 40, No. 11 (1997)
19. *Solution for Agraffe Noise, PTJ*, Vol. 32, No. 8 (1989)
20. *Q. and A. Fuzzy, False Tone, PTJ*, Vol. 29, No. 3 (1986)
21. Virgil E. Smith *Criminal Negligence in Piano Service, PTJ*, Vol. 36, No 10 (1993)
22. David W. Pitsch, RPT, *After Touch, PTJ*, Vol 25, No 12 (1982)
23. Susan Graham, *Agraffes, PTJ*, Vol. 27, No. 5 (1984)
24. Selections from *Five Lectures on The Acoustics of the Piano Proceedings of the Royal Swedish Academy of Piano* (1990) as published at www.speech.kth.se In addition to the patents uncovered, the nonpatent references, as cited above, uncovered a series of five lectures entitled, *The Acoustics of the Piano*, sponsored by the Royal Swedish Academy of Music (1990). While there was some emphasis on aftersound and the physics of sound upon a hammer striking a string, there is seemingly no mention of the effect of unlevel strings on the voicing or on the damping mechanism. In fact, the discussion seems to indicate that some roughness at the edge of the notes was deliberate, which teaches away from the precise string leveling, infra.

In Clair Davies teaching before the Piano Technicians Guild (PTG) convention about string leveling, he uses the square end of a steel rule to check that the strings are coplanar and does not use the key bed as reference. This teaching also indicates that Franz Mohr called string leveling part of the "open work" of piano tuning.

With the foregoing background in mind, the purpose of the present invention is to provide a novel string leveling device which precisely gauges the condition of the bichords and trichords of a grand piano with reference to the upper surface of the key bed. The disclosed invention also encompasses a method of using the apparatus as a preliminary step to voicing a grand piano, adjusting the damping mechanism and regulating the una corda pedal.

SUMMARY OF THE INVENTION

Briefly, in accordance with one aspect of the present invention, an apparatus or unison gauge for indicating levelness of a string set includes a contact block adjustably engageable with the lowermost tangential aspect of the string set under examination and a set of battery powered indicators providing an indication for each string. With the piano action withdrawn from the piano case, the base of the device is designed to rest on the key bed below the piano hammer strike area of the string set and to hold the contact block, which is mounted thereon on an extendable mast or probe, with the contact face thereof in a plane parallel to the key bed. The mast can be raised or lowered to conform the gauge to the grand piano being examined. Each contact block provides at least two contact points for each string of a string set and has a corresponding indicator therefor. When in the case of a trichord with all strings level, in this embodiment, the strings contact all six contact points and completes the circuits for all three indicators. The contact block is under slight spring tension when engaged with a string set, which is being monitored and, upon release of the spring tension readily slides along the key bed to the next string set. The unison gauge of this invention brings precision to string leveling, while at the same time saving several hours of the piano technician's time.

The present invention is effective in measuring the levelness of the string sets of a grand piano and is useful at the manufacturing level for quality assurance and is of even greater use in field maintenance procedures where string leveling is a preliminary step to voicing, damping mechanism adjustment, and una corde pedal regulation. The gauge is relatively small, portable, handheld, and is easy to use by a piano technician during grand piano production or field maintenance of grand pianos.

In method of use of the Russo unison gauge of this invention (as the hammer strike areas of the various unisons are arrayed on a slightly arced path following the bridge of the grand piano), the gauge is first adjusted so that the altitude upon extension is slightly greater than the highest unison with respect to the key bed surface. The gauge is then aligned so that the contacts for a particular string are in line. This assures that when a 3×2 contact array is elevated to contact, for example, a trichord string set, all six contacts are in contact upon finding a level string set. If an indication of an unlevel condition occurs, the sagging string is then shortened or lifted to the right height using a string hook (or a low-effort string hook—see Reference 18 by Clair Davies, supra.

OBJECTS AND FEATURES OF THE INVENTION

Accordingly, it is the primary object of the present invention to provide a new and novel device to ascertain the levelness of string sets of a grand piano.

It is another object of the present invention to provide a new and novel device to ascertain that the hammer strike points of a string set—namely a bichord or a trichord—lie in a line parallel to the key bed.

It is yet another object of the present invention to provide a levelness device for a grand piano which is easy to use and economical to manufacture.

It is still yet another object of the present invention to provide a device that eliminates piano aftersound by precisely leveling string sets.

It is a feature of the present invention that the string leveling device hereof is readily moved from one string set to another and has a baseplate for using the upper surface of the key bed as a reference plane.

It is another feature of the present invention that the contact surface of the string leveling device is readily raised into and lowered from tangential engagement with the string set at the hammer strike point.

It is yet another feature of the present invention that the extension of the string leveling device encompasses the range of elevation of the strings sets in presently marketed grand pianos.

Other objects and features of the invention will become apparent upon review of the drawing and the detailed description which follows.

BRIEF DESCRIPTION OF THE DRAWING

In the drawing as hereinafter described, preferred embodiments are depicted; however, various other modifications and alternate constructions can be made thereto without departing from the true spirit and scope of the invention. Also, in the drawing which follows, the same part in the various views is provided the same reference designator.

DESCRIPTION OF THE PREFERRED EMBODIMENTS

Before embarking on the description of the device, several terms are defined for the purpose of adding clarity to this specification and the claims which follow. Here the term unison refers to a string set, which, in turn, is a bichord or trichord, that is played as one note by the percussive force of a piano hammer. The term bichord is defined as a unison or string set having two strings that is played as one note by the percussive force of a piano hammer. The term trichord is defined as a unison or string set having three strings that is played as one note by the percussive force of a piano hammer. The term voicing is defined as the final adjustment of a piano and includes trimming, hardening, needling, and, if necessary, replacing the hammer felts. The term damping mechanism adjustment is defined as the procedure by which the dampers and the damper lift mechanism are adjusted to ensure accurate damping performance. The una corda pedal is defined as the pedal for shifting the piano action so that, while the pedal is depressed, the respective piano hammers strike only one string of a bichord and only two strings of a trichord.

Figure 1:
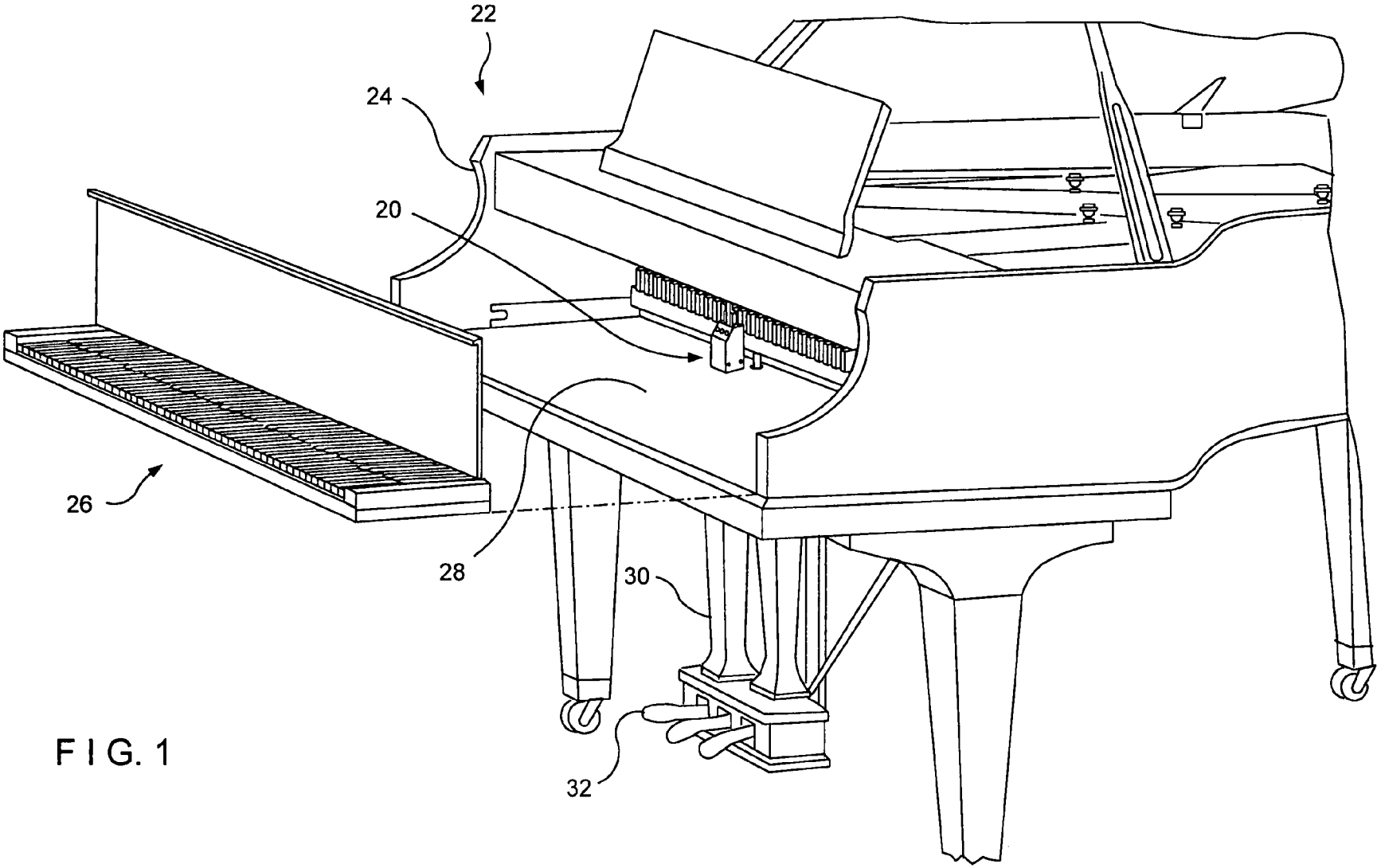
FIGS. 1 and 1A are partial perspective views of a grand piano with the piano action withdrawn and the unison gauge of this invention positioned between the piano key bed and a trichord with FIG. 1 showing the details of the lyre structure, and FIG. 1A, of the damper mechanism.
Figure 1A:
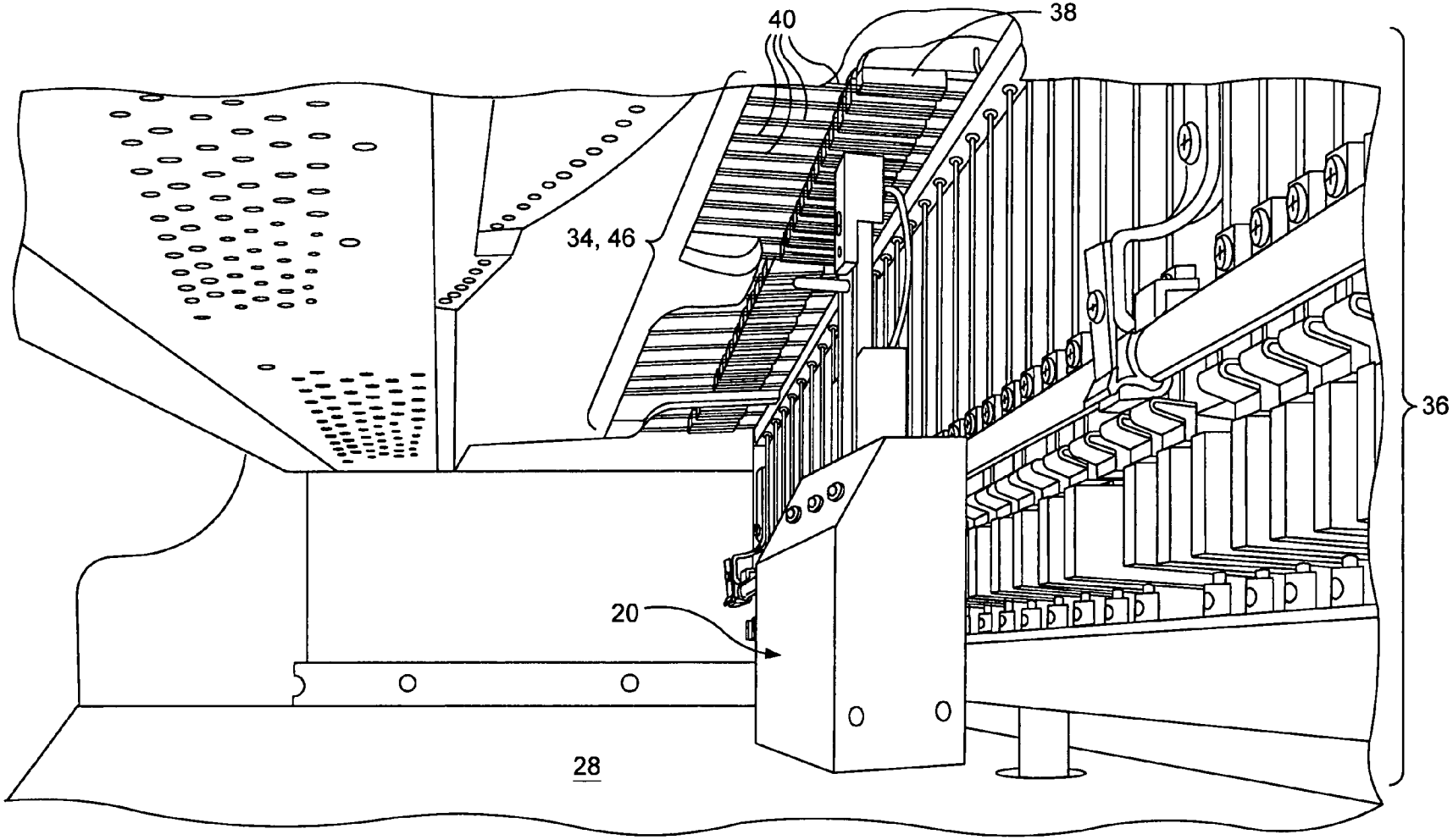

Referring now to FIGS. 1 and 1A partial perspective views of a grand piano are shown with the piano action withdrawn and the unison gauge of this invention positioned between the piano key bed and a trichord. The Russo unison gauge is referred to generally by the reference designator 20. A grand piano 22, with which the unison gauge 20 of this invention is used, is shown as having a piano case 24 with a piano action 26 withdrawn therefrom. Surrounding the piano action 26 is the piano case 24 and beneath the withdrawn piano action 26 and extending rearward therefrom is a key bed 28—a flat expanse providing support for the piano action 26. Depending from the piano case 24 is a pedal-supporting lyre structure 30 with a una corda pedal 32 on the left side thereof. Across and atop a string assembly 34, a damper mechanism 36 is disposed with a damper 38 to cut off the resonating of each associated string or string set 40. In this figure, the unison gauge 20 is shown extended between the key bed 28 and the string set 40 of string assembly 34.

Figure 2:
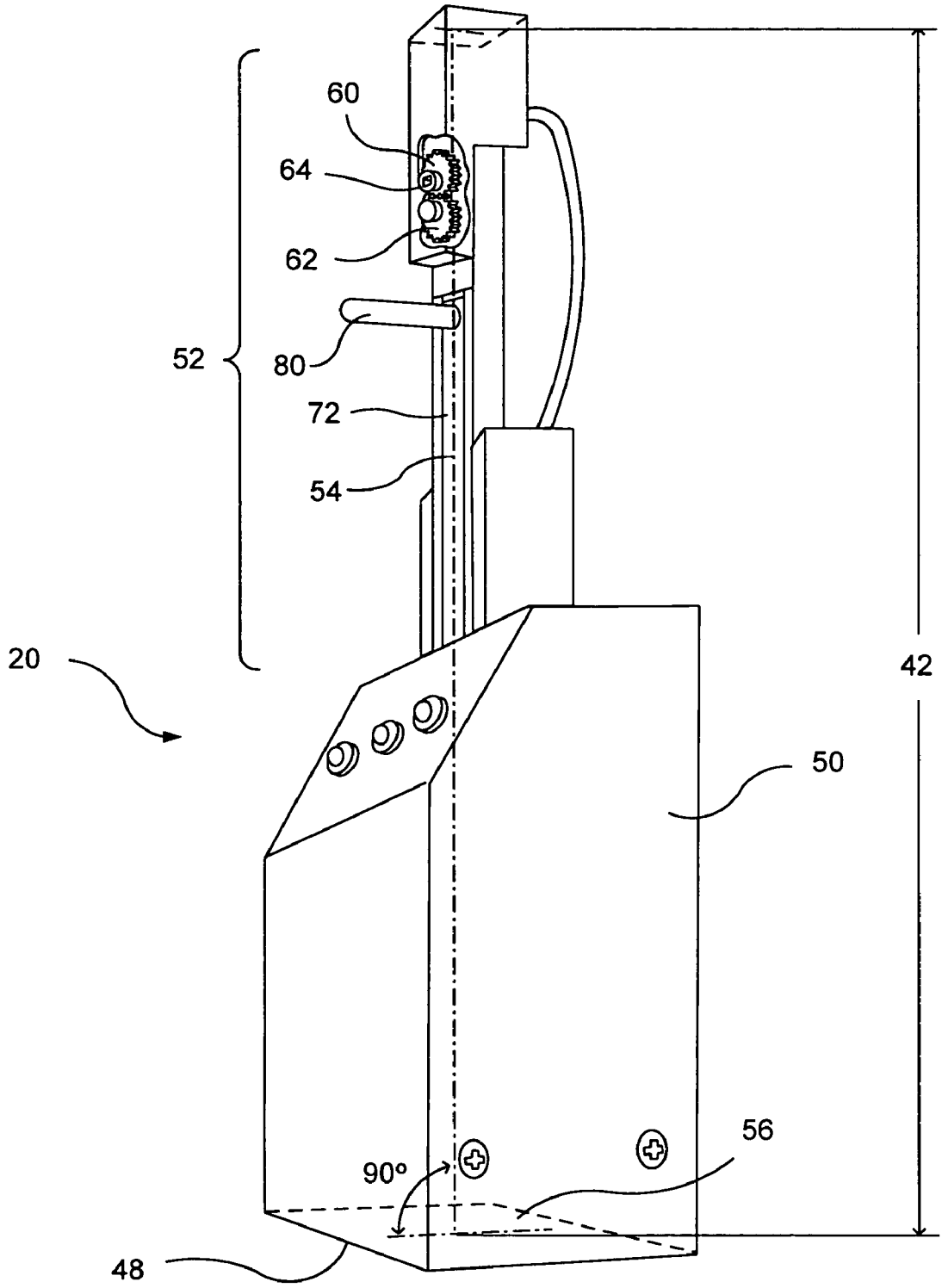
FIG. 2 is a partially cutaway perspective view of the unison gauge of FIG. 1 showing the mast elevation mechanism for adjusting the gauge to the piano under string leveling.
Figure 3:
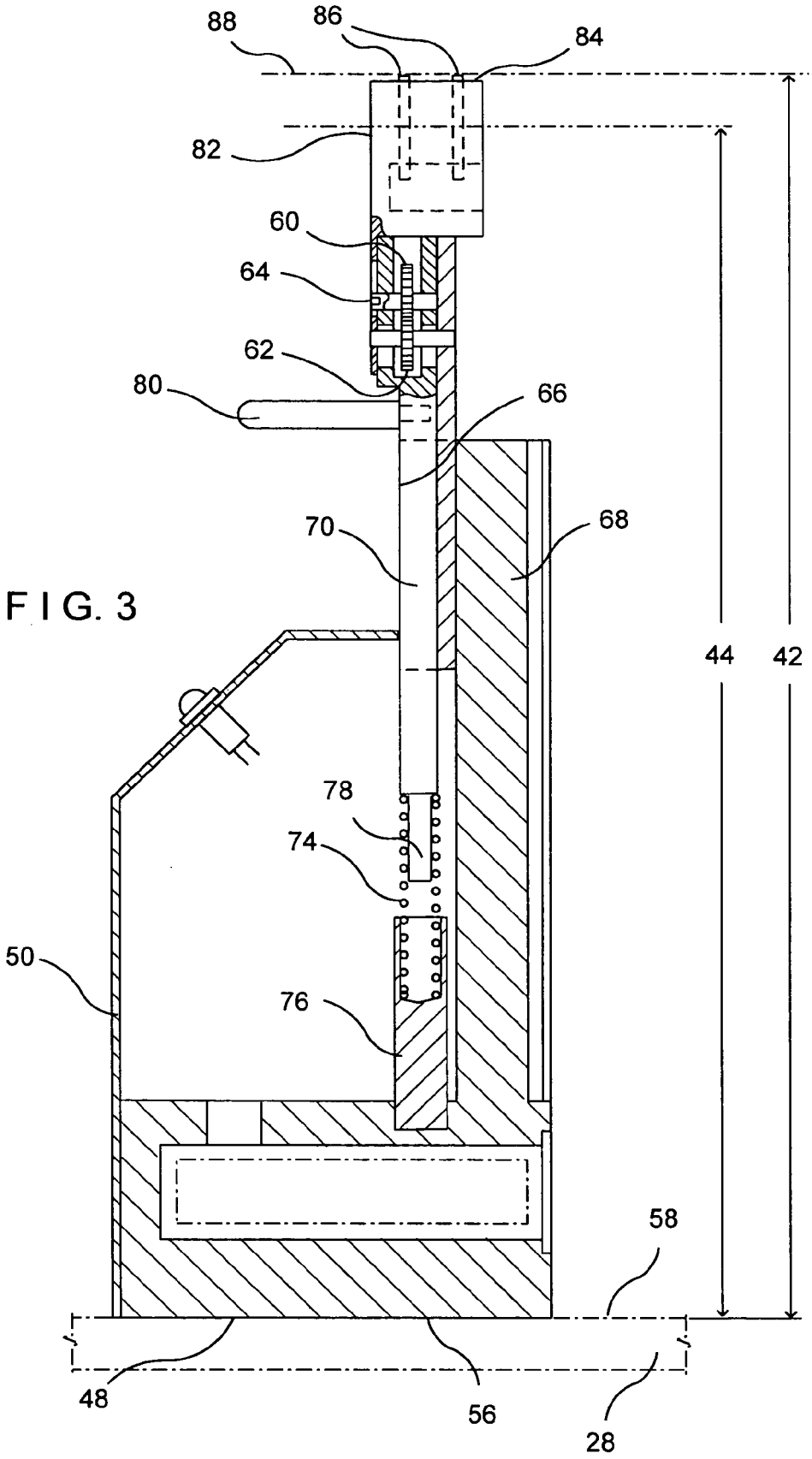
FIG. 3 is a cross-sectional view of the unison gauge showing the mast extended to bring the contacts of the contact block into tangential engagement with a level trichord having a sagging string.

Referring now to FIGS. 2 and 3 are respectively perspective and sectional views of the unison gauge of the invention shown in FIG. 1. Here the mast elevation mechanism for adjusting the external gauge range to the piano under string leveling. Each unison gauge 20 has two operating ranges, namely, (1) an external range 42 and (2) an internal range 44. The external range 42 of a unison gauge 20 for a grand piano depends on and is fixed by the manufacturer, and as there is no industry-wide standardization, the maximum height between key bed and string set varies brand-to-brand from 6.5 to 9.5 inches. The string array 46 of string assembly 34 is slightly arcuate and in a grand piano wherein the external range is for example 7.75 inches (max.) the minimum-to-maximum range of key bed to string set heights is from 7.00 inches to 7.75 inches. This then determines the internal range 44 of operation of a unison gauge.

Returning to FIG. 2, the structure of the unison gauge 20 is next discussed. In this embodiment, the gauge 20 has a flat base 48 for emplacement of the gauge on key bed 28. As will be ascertained from the discussion, infra, the key bed 28 is used as a reference plane and the flatness characteristic of the base 48 is translated into the precision gauging of the string set levelness. Upon the base 48, a gauge housing 50 is constructed and receives therein a mast assembly 52 which is slidably mounted to move along an axis line 54 normal to the lower surface 56 of base 48 and the upper surface 58 of key bed 28. The mast assembly 52 is a gear arrangement that raises and lowers the entire mast assembly 52 to a fixed position thereby setting the external range 42. Here, the gear arrangement consists of worm or drive gear 60 and mating or driven gear 62 with the drive gear 60 rotated by control knob 64. While shown herein by a worm gear unit, any suitable mechanical device that translates the motion into displacement along the mast axis including, but not limited to a slider-crank mechanism, a ratchet, or a rack and pinion arrangement, would be within the contemplation of this invention.

Referring now to both FIGS. 2 and 3, the mast assembly 52 is described in some detail. The mast 66 includes a support mast or fixed portion 68 and a slidable mast or movable portion 70 for extension and retraction along channel 72 of support mast 68. Although the support mast 68 is shown as female and the slidable mast 70 is shown as male, the interengagement function is readily reversible. Likewise, the slidable mast 70 is optionally constructed as telescoping within the support mast 68. A spring 74 extends from a lower spring holder 76 attached to base 48 to upper spring holder 78 attached to slidable mast 68. When the spring 74 is relaxed (not compressed), the unison gauge 20 is in the fully extended condition—limited, of course, by the selected external range 42.

Medial the slidable mast portion 70, a handle 80 is attached thereto and adapted to retracting or lowering the mast assembly 52 by compressing and holding compressed spring 74. Compression of the spring in this manner releases the gauge that was held between the key bed and a particular unison and enables the operator to move the gauge to the next unison to be checked for levelness.

Referring now to FIG. 3 a cross-sectional view is shown of the unison gauge 20 with the mast extended to bring the contacts of the contact block into tangential engagement with a level trichord. At the end of the slidable mast portion 70 opposite the base 48, a contact block 82 is mounted thereon. The contact block 82 is constructed with the upper surface 84 thereof lying in a plane parallel to lower surface of base 48. The upper surface 84 of contact block 82 contains contact points 86 arrayed in grid which adapts the structure for tangential engagement with the trichord being leveled. The contact block 82 has two contact points 86 for each string and, when the trichord is level, each string is in contact with both of the corresponding contact points 86. With the geometry of the gauge as discussed above, indication that each string of the specific trichord is level shows: (1) the two contact points lie in a line 88 parallel to lower surface 56 of base 48 and upper surface 58 of key bed 28; (2) the six tangentially engaged contact points lie within three parallel lines 88 in upper surface 84 of contact block 82; and, (3) because of the internal range 44, while the plane of each trichord may be at a slightly different altitude with respect to upper surface 58 of key bed 28, the plane is parallel to the key bed.

Figure 4:
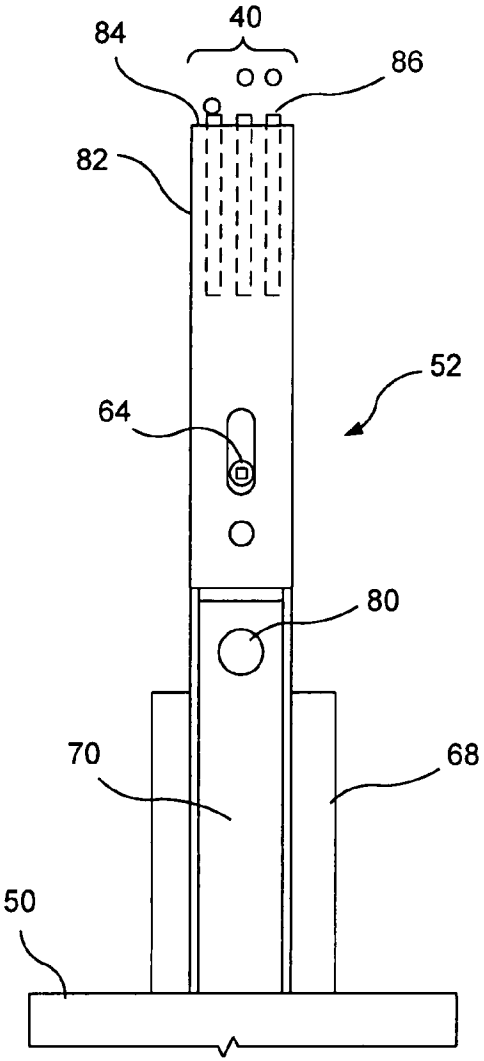
FIG. 4 is a cross-sectional view of the unison gauge showing the mast extended to bring the contacts of the contact block into tangential engagement with the trichord being leveled.

Referring now to FIG. 4 a cross-sectional view is shown of the unison gauge 20 with the mast extended to bring the contacts of the contact block into tangential engagement with a trichord having a sagging string. It is noted that the spring tension of spring 74 at the relaxed condition is selected so as to be insufficient to impel a sagging string of a unison to the properly aligned position. Thus, a sagging string will always create a non-indication of levelness with respect to the other strings in the string set and will not provide a level indication until the condition is remedied.

Figure 5:
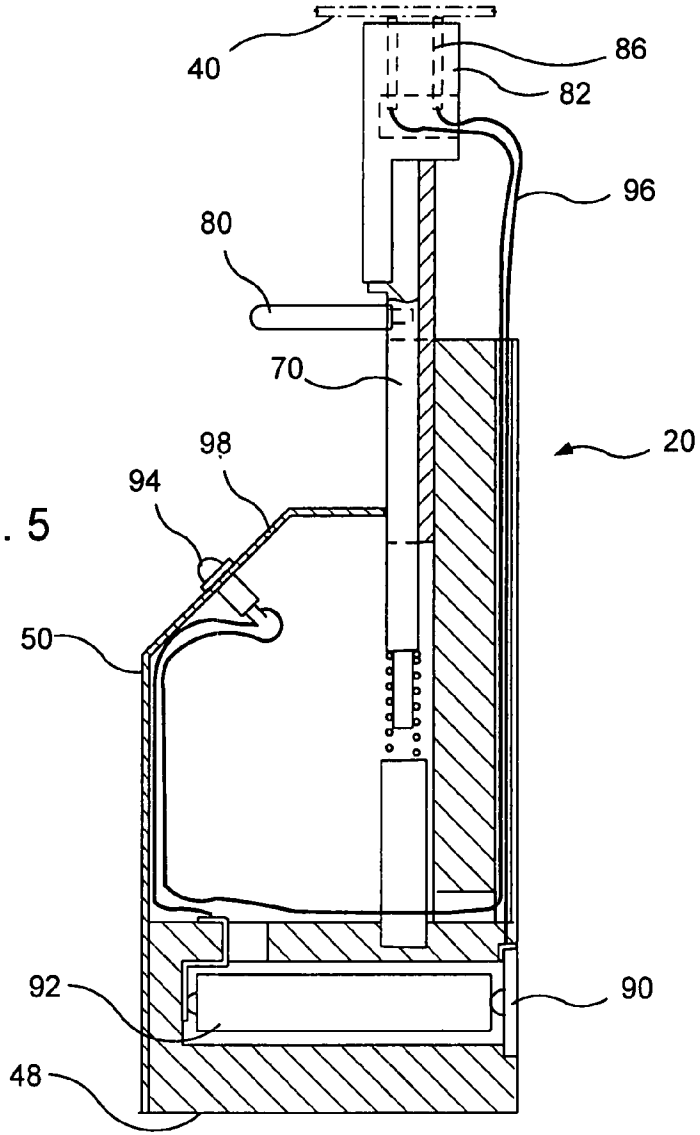
FIG. 5 is a detailed view providing a schematic representation of the indicator panel, the circuitry and power supply arrangement.

The unison gauge 20 provides indication of levelness through a series of indicators. The indicators shown are battery-powered, light emitting diodes mounted on gauge housing 50. The physical positioning of the indicators is best seen in FIGS. 2, 3 and 4 with the circuitry in FIG. 5. A battery compartment access panel 90 slides to one side and covers a 1.5 volt battery 92 adjacent the base 48 of unison gauge 20. For the trichord unison 40, a light emitting diode (LED) 94 is associated with each string of the string set. A wiring harness 96 extends from the contact block 82 mounted on the slidable mast 70 to an indicator panel 98 on gauge housing 50. Three parallel lines accommodate the LED's 94 with the circuit for each indicator being completed by the respective string. A low battery indication is optionally provided.

Figure 6:
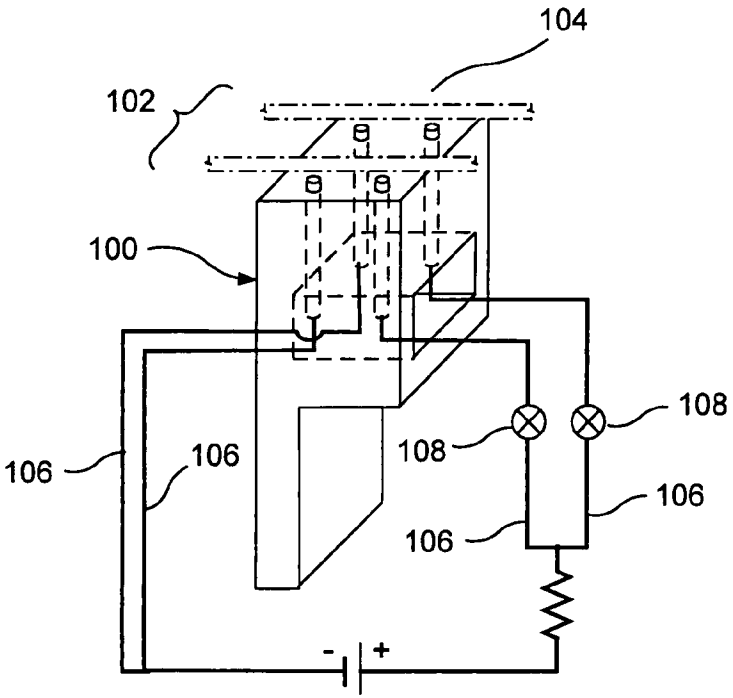
FIG. 6 is a detailed view of a interchangeable contact block for the unison gauge of FIG. 2 for tangential engagement with a bichord unison.

Referring now to FIG. 6, an interchangeable contact block 100 is shown. This contact block is used for determining the string levelness of a bichord unison 102. In lieu of the 3×2 matrix of contact block 82, here a 2×2 matrix of contact points 104 is employed. For indication of levelness a two-branch parallel circuit structure 106 is associated with LED's 108.

Figure 7:
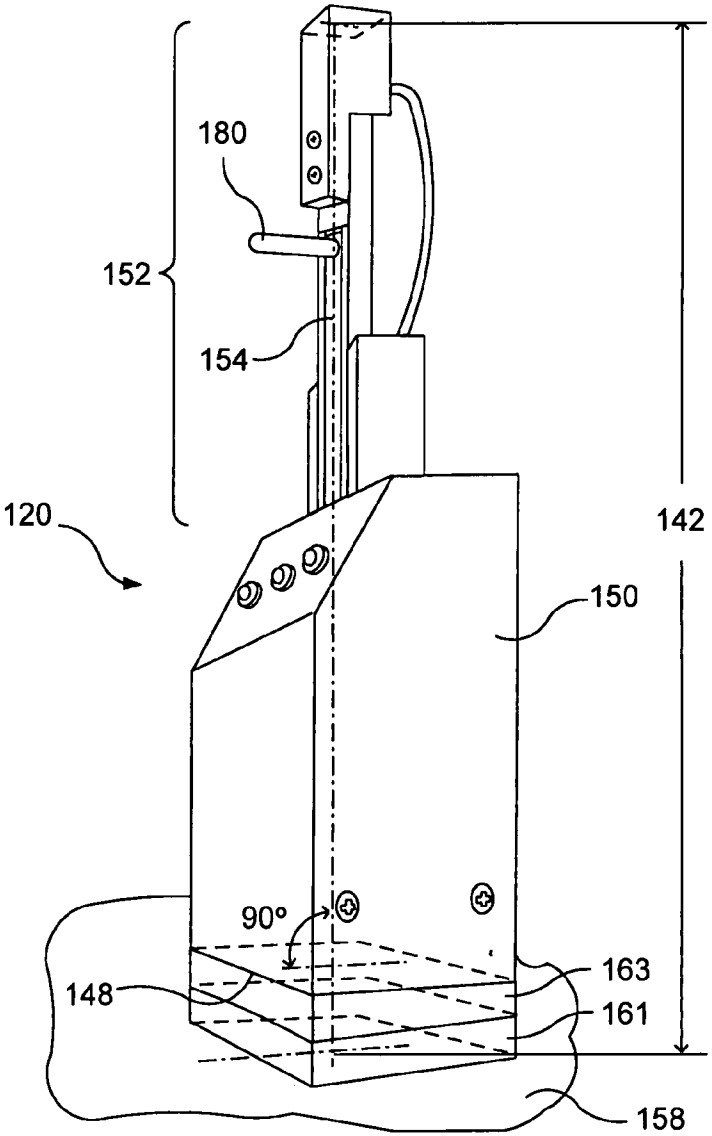
FIG. 7 is a partially cutaway perspective view of a second embodiment of the unison gauge of this invention using a series of precision base blocks to elevate the device.

A second embodiment of the unison gauge of this invention is shown in FIG. 7. Here similar parts to those in the first embodiment are provided with reference designators 100 units higher than those in the first embodiment. Thus the mast assembly 152 of the second embodiment is similar to mast assembly 52 of the first embodiment. In this embodiment the means of elevating the unison gauge 120 differs from that described, supra. In lieu of an internal mechanism, precision-machined base blocks 161 and 163 that nest the one with the other and with the base 148 are used to elevate the unison gauge 120. While these base blocks increase the external range 142 by 1-inch increments from 6.4 inches to 9.5 inches, special base blocks are optionally available for given makes of grand pianos, e.g. a Steinway block or a Kawai block.

Figure 8:
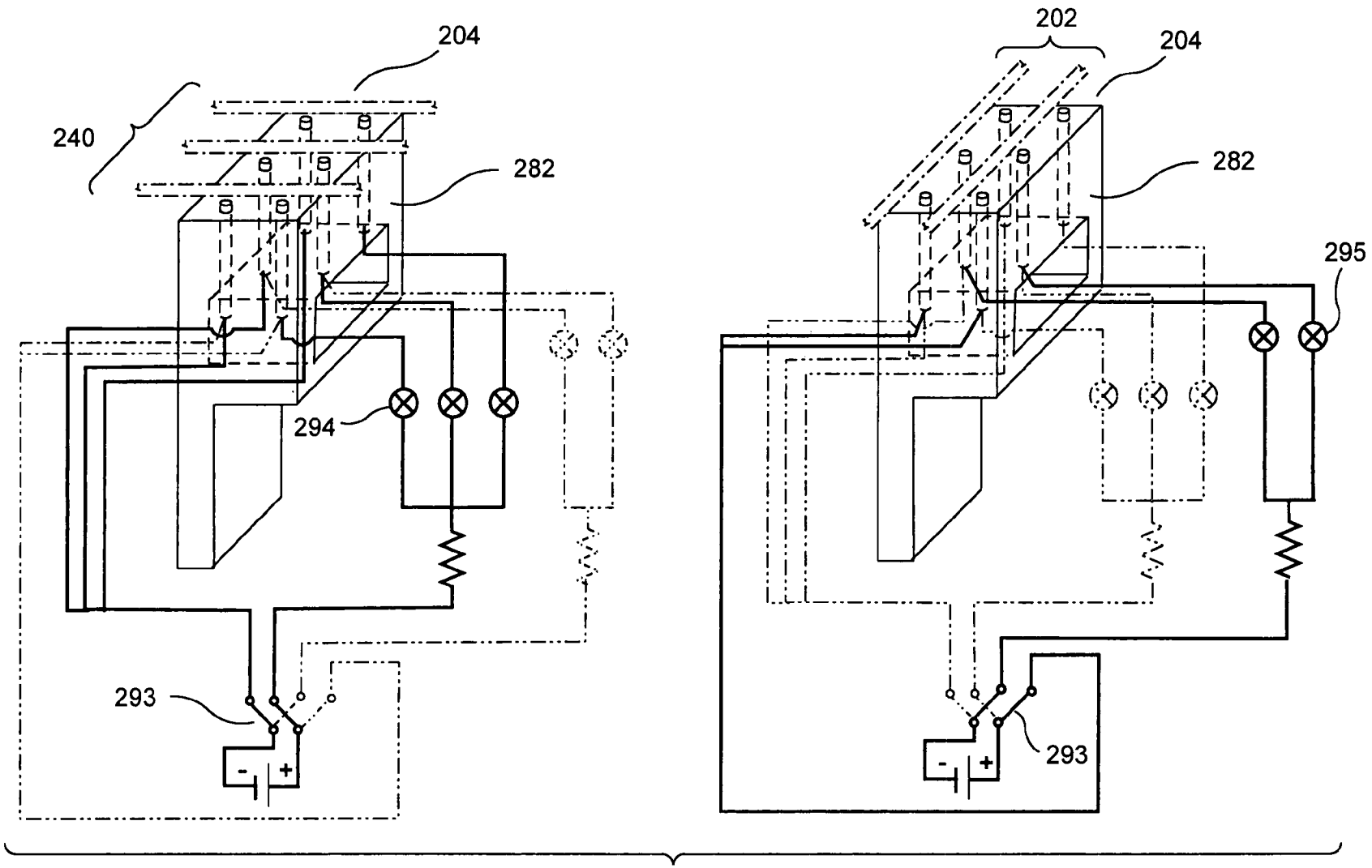
FIG. 8 is a partially cutaway perspective view of a third embodiment of the unison gauge of this invention, which embodiment accommodates the gauging of both bichords and trichords; and, FIG. 9 is a view of a piano technician shortening a sagging string of a string set to bring all the strings in the unison to a level condition.

A third embodiment of the unison gauge of this invention is shown in FIG. 8. Here similar parts to those in the first embodiment are provided with reference designators 200 units higher than those in the first embodiment. Thus the mast assembly 252 of the third embodiment is similar to mast assembly 52 of the first embodiment. In this embodiment the unison gauge 220 incorporates both a trichord mode and a bichord mode and indicates levelness in either mode. A mode switch 293 switches between a three-light set of light emitting diodes 294 with an associated three-branch, parallel circuit, as above, and a two-light set of light emitting diodes 295 with an associated two branch, parallel circuit. The contact block 282 uses the 3×2 matrix 304 thereof to ascertain the levelness of trichord unisons and upon switching modes the same (now 2×3) matrix 304 to ascertain the levelness of the bichord unisons. The technician using the gauge needs only to switch the mode and to rotate the gauge 220 at a right angle to the other mode.

In operation, string leveling is performed as a preliminary step to several manufacturing and maintenance procedures for the grand piano. As indicated above, these include voicing, damping mechanism adjustment and una corda pedal action. The rationale for leveling strings is slightly different in each case but significantly each string leveling operation concerns the interaction of felted, movable mechanical parts with piano strings. When a damper head falls on a unison, if two strings are high and one is low, the low string will not be properly damped. When a hammer strikes an unlevel string set, a complex of tones, rather than a single one, emanates from the unison. When a una corda pedal is depressed, an unlevel string, which is purposely rendered inoperative by the pedal action, often catches the corner of a piano hammer and does not provide the desired pianissimo effect. String leveling is considered preliminary because the strings provide a "roadway" on which the felted, movable mechanical parts operate and it is more sensible to fix the "potholes" than all the suspension problems arising from a rough ride.

A note is now inserted about selection of the external range. The selectability of the external range is only important to the Russo unison gauge user who maintains or re-manufactures a variety of grand pianos. This invention contemplates the ability to construct unison gauges operable over the entire external range without adjustment and also unison gauges which have fixed external ranges. For these reasons the selection is considered an optional step in the methodology.

Figure 9:
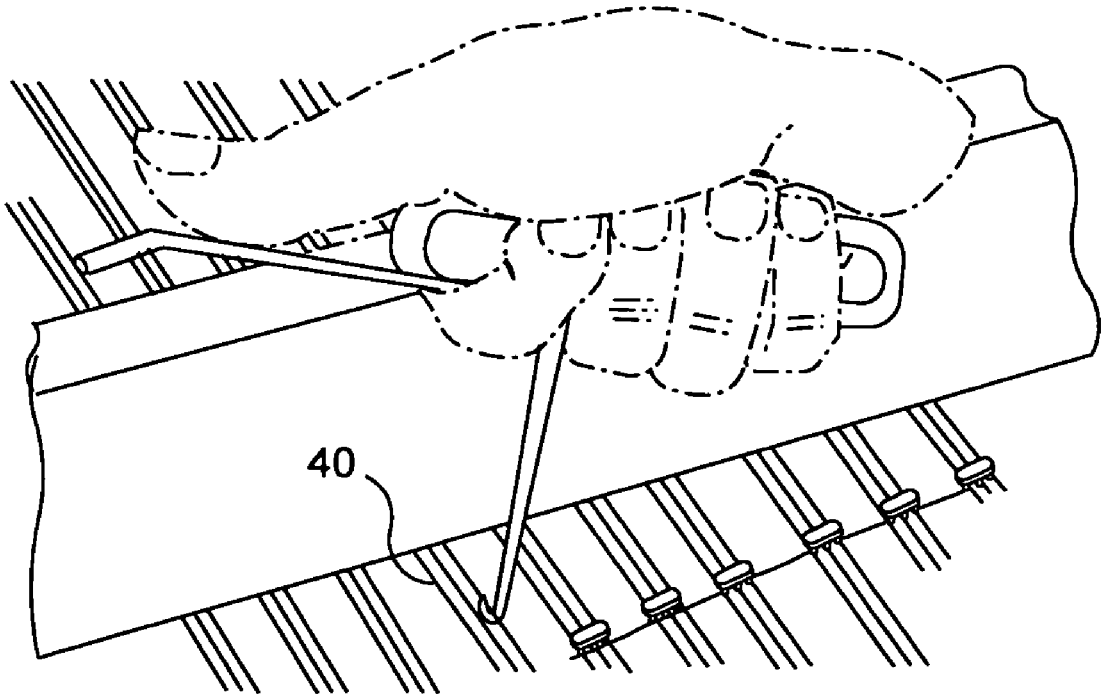

The general steps of string leveling are as follows:

a. withdrawing the piano action from the piano case to provide access to the key bed and the strike area of the string sets;

b. optionally selecting the external range for the unison gauge, with the compression capability thereof including the minimum and maximum altitudes of the string sets being leveled;

c. placing the unison gauge on the key bed having the contact points of the gauge head aligned with the longitudinal axis of the strings of the string set and having a row of contact points for each string of a string set;

d. compressing the unison gauge by using the handle therefor and moving the gauge head downwards towards the base;

e. releasing the gauge for tangential contact between the string-set-under-test and the contact points of the gauge head;

f. completing the circuit for the LED indicators and observing the display;

g. shortening, as required, the sagging string of the string set, see FIG. 9;

h. repeating steps c. through f. until all contact points are indicated as being in the same plane;

i. compressing the unison gauge by using the handle therefor and moving the gauge to the next string-set-under-test; and, j. repeating steps e. through h. until all unisons have been tested for levelness.

The following steps of string leveling applies to the embodiment of the unison gauge which uses two separate contact heads, namely, one for trichord and the other for bichords:

a. through i. using the trichord contact head repeat steps a. through h. as in the preceding paragraph;

j. (not used);

k. repeating steps e. through h. until all trichords are indicated as being level;

l. demounting the trichord contact head and securing in lieu thereof the bichord contact head; and m. repeating step e. through i. until all bichords are indicated as being level.

While the preferred embodiment of our invention has been described fully in order to explain its principles, it is understood that various modifications or alterations may be made to the preferred embodiment without departing from the scope of the invention as set forth in the appended claims.

What is claimed is:

1. A unison gauge for determining the levelness of string sets of a grand piano, said gauge used with a grand piano having a piano action withdrawn along a key bed of a piano case, said unison gauge insertable into said piano case between said key bed and said string set, said unison gauge comprising:

a base;

a mast arising from said base adapted to extend to and retract from said string set; and a plurality of contacts mounted on said mast, said contacts arrayed, when said unison gauge is disposed said key bed, in a plane parallel to said upper surface of said key bed and adapted for tangentially contacting the lowermost edge of said string set; and, a plurality of indicators indicating said string set is level with said contacts being on a plane parallel to said upper surface of said key bed and, if not, indicating the portion of said string set that is not level.

2. A unison gauge as described in claim 1 wherein said string set comprises two or three strings and wherein said indicator is a plurality of light emitter diodes (LED's) with each one associated with a selected string, said gauge further comprising:

a power source in cooperative functional relationship with said LED's;

said indicator adapted, upon each of said strings of said string set tangentially contacting said contacts, to illuminate corresponding associated LED's and indicate that a level condition exists.

3. A unison gauge as described in claim 1 wherein said unison gauge further comprises:

a handle attached to said mast for retracting said contacts from tangential contacting of said string set and for sliding said unison gauge, while retracted, along said key bed to align with the next string set to be leveled.

4. A unison gauge as described in claim 3 wherein said unison gauge further comprises:

elevator means for raising and lowering said gauge with respect to said base and, in turn when operative, with respect to said upper surface of said key bed;

whereby said unison gauge is adaptable to all grand pianos regardless of the spacing between said upper surface of said key bed and the underside of said string sets.

5. A unison gauge as described in claim 4 wherein said elevator means comprises:

crank means for applying rotational force;

a drive gear attached to said crank means; and, a driven gear translating said rotational force into linear movement of said mast and said plurality of contacts and thereby setting the external range of the unison gauge.

6. A unison gauge as described in claim 4 wherein said elevator means comprises:

one or more base blocks for nesting with one another and with said base of said unison gauge, said base blocks used in combination to raise said unison gauge to a height in an uncompressed state greater than the minimum altitude between said key bed and said unison.

7. A string leveling gauge for insertion into a grand piano, with the piano action thereof withdrawn, said insertion between an upper surface of a key bed of said grand piano and a strike area of a selected string set, each said string set having two or three strings, said string leveling gauge comprising:

a base adapted for disposition and movement along said key bed to said selected string set;

a stem rising from said base and extendable and retractable from said selected string set; and a contact block for tangential contacting of said string set, said contact block mounted on said stem and having an upper surface thereof held in a plane parallel to said upper surface of said key bed, said contact block, in turn comprising;

two or three rows of contacts in an array corresponding to said spaced apart strings;

elevator means attached to said mast for retracting said contact block from tangential contact with said string set and enabling in the retracted state the sliding of said unison gauge along said key bed to align with the next string set to be leveled; and, said contact block, upon being extended into contact with said selected string set, sensing the levelness of the selected string set is detected.

8. A string leveling gauge as described in claim 7, wherein said contact block has an array of contacts in a 3×2 matrix with each row of two contacts serves to detect the levelness of one string of a trichord.

9. A string leveling gauge as described in claim 7, wherein said contact block has an array of contacts in a 2×2 matrix with each row of two contacts serves to detect the levelness of one string of a bichord.

10. A string leveling gauge as described in claim 7, wherein said contact block has an array of contacts in a universal 3×2/2×3 matrix in which each row of two contacts, operating in a first mode, serves to detect the levelness of one string of a trichord, and, in which each row of three contacts, operating in a second mode, serves to detect the levelness of one string of a bichord.

11. A method of using the unison gauge of this invention for string leveling a unison of a grand piano, said method including the steps of:

a. withdrawing the piano action from the piano case to provide access to the key bed and the strike area of the string sets;

b. optionally selecting the external range for the unison gauge, with the compression capability thereof including the minimum and maximum altitudes of the string sets being leveled;

c. placing the unison gauge on the key bed having the contact points of the gauge head aligned with the longitudinal axis of the strings of the string set and having a row of contact points for each string of a string set;

d. compressing the unison gauge by using the handle therefor and moving the gauge head downwards towards the base;

e. releasing the gauge for tangential contact between the string-set-under-test and the contact points of the gauge head; and, f. completing the circuit for the LED indicators and observing the display.

12. A method as described in claim 11 comprising the additional steps of:

g. shortening, as required, the sagging string of the string set; and, h. repeating steps c. through f. until all contact points are indicated as being in the same plane.

13. A method as described in claim 12 comprising the additional steps of:

i. compressing the unison gauge by using the handle therefor and moving the gauge to the next string-set-under-test; and, j. repeating steps e. through h. until all unisons have been tested for levelness.

14. A method of using the unison gauge of this invention for string leveling of a trichord of a grand piano, said unison gauge having a contact head with a 3×2 matrix of contact points, said method comprising the steps of:

a. withdrawing the piano action from the piano case to provide access to the key bed and the strike area of the string sets;

b. optionally selecting the external range for the unison gauge, with the compression capability thereof including the minimum and maximum altitudes of the string sets being leveled;

c. placing the unison gauge on the key bed having the contact points of the gauge head aligned with the longitudinal axis of the strings of the string set and having a row of contact points for each string of a string set;

d. compressing the unison gauge by using the handle therefor and moving the gauge head downwards towards the base;

e. releasing the gauge for tangential contact between the string-set-under-test and the contact points of the gauge head; and f. completing the circuit for the LED indicators and observing the display.

15. A method as described in claim 14 comprising the additional steps of:

g. shortening, as required, the sagging string of the string set; and, h. repeating steps c. through f. until all contact points are indicated as being in the same plane.

16. A method as described in claim 15 comprising the additional steps of:

i. compressing the unison gauge by using the handle therefor and moving the gauge to the next string-set-under-test; and, j. repeating steps e. through h. until all unisons have been tested for levelness.

17. A method of using the unison gauge of this invention for string leveling of a bichord of a grand piano, said unison gauge having a contact head with a 2×2 matrix of contact points, said method comprising the steps of:

a. withdrawing the piano action from the piano case to provide access to the key bed and the strike area of the string sets;

b. optionally selecting the external range for the unison gauge, with the compression capability thereof including the minimum and maximum altitudes of the string sets being leveled;

c. placing the unison gauge on the key bed having the contact points of the gauge head aligned with the longitudinal axis of the strings of the string set and having a row of contact points for each string of a string set;

d. compressing the unison gauge by using the handle therefor and moving the gauge head downwards towards the base;

e. releasing the gauge for tangential contact between the string-set-under-test and the contact points of the gauge head; and f. completing the circuit for the LED indicators and observing the display.

18. A method as described in claim 17 comprising the additional steps of:

g. shortening, as required, the sagging string of the string set; and, h. repeating steps c. through f. until all contact points are indicated as being in the same plane.

19. A method as described in claim 18 comprising the additional steps of:

i. compressing the unison gauge by using the handle therefor and moving the gauge to the next string-set-under-test; and, j. repeating steps e. through h. until all unisons have been tested for levelness.

* * * * *